US008434703B2

(12) United States Patent
Przybyla

(10) Patent No.: US 8,434,703 B2
(45) Date of Patent: May 7, 2013

(54) APPARATUS AND METHOD FOR COMMINUTION OF MINERAL ORE

(75) Inventor: Jan S. Przybyla, Chelmsford (GB)

(73) Assignee: E2V Technologies (UK) Limited, Chelmsford Essex (GB)

( * ) Notice: Subject to any disclaimer, the term of this patent is extended or adjusted under 35 U.S.C. 154(b) by 303 days.

(21) Appl. No.: 12/867,663

(22) PCT Filed: Feb. 10, 2009

(86) PCT No.: PCT/GB2009/050130

§ 371 (c)(1),
(2), (4) Date: Nov. 16, 2010

(87) PCT Pub. No.: WO2009/101435

PCT Pub. Date: Aug. 20, 2009

(65) Prior Publication Data

US 2011/0057061 A1 Mar. 10, 2011

(30) Foreign Application Priority Data

Feb. 15, 2008 (GB) ..... 0802843.3

(51) Int. Cl.
*B02C 19/00* (2006.01)
*B02C 13/286* (2006.01)

(52) U.S. Cl.
USPC ..... 241/1; 241/301

(58) Field of Classification Search ..... 241/1, 301
See application file for complete search history.

(56) References Cited

U.S. PATENT DOCUMENTS

| | | | |
|---|---|---|---|
| 2001/0000403 | A1 | 4/2001 | Gaisford et al. |
| 2005/0236403 | A1 | 10/2005 | Kingman |

FOREIGN PATENT DOCUMENTS

| | | | |
|---|---|---|---|
| DE | 905555 | A | 9/1962 |
| GB | 1 317 477 | A | 5/1973 |
| JP | 04063001 | A | 2/1992 |
| WO | WO-03/083146 | A1 | 10/2003 |
| WO | WO-03/102250 | A1 | 12/2003 |
| WO | WO-2006/030327 | A2 | 3/2006 |
| WO | WO-2006/037842 | A1 | 4/2006 |
| WO | WO-2007/069980 | A1 | 6/2007 |
| WO | WO-2008/017120 | A1 | 2/2008 |
| WO | WO-2008/147420 | A1 | 12/2008 |
| ZA | 8702406 | A | 11/1987 |

OTHER PUBLICATIONS

International Search Report issued in application No. PCT/GB2009/050130 dated Aug. 11, 2009.
United Kingdom Search Report issued in application No. GB0802843.3 dated May 8, 2008.
WPI abstract accession #1998-056701 [08].

*Primary Examiner* — Faye Francis
(74) *Attorney, Agent, or Firm* — Venable LLP; Robert Kinberg

(57) ABSTRACT

An apparatus and method for comminution of ore material includes a radio frequency multi-input, multimode processing resonant cavity arranged for radio frequency electromagnetic irradiation of a stream of ore material passing therethrough. A multi-input measurement resonant cavity, located upstream of the processing resonant cavity may be provided to determine an impedance of ore material to be irradiated in the processing resonant cavity. The radio frequency electrical field generated in the processing resonant cavity is matched to the determined impedance.

27 Claims, 3 Drawing Sheets

APPARATUS AND METHOD FOR COMMINUTION OF MINERAL ORE

This invention relates to an apparatus and method for comminution of mineral ore Proposals for the comminution of mineral ore using radio frequency radiation, and in particular microwave radiation, are well known. However there has been a lack of a suitable arrangement for exposing ores to microwaves.

Thus, for example, WO 03/102250 proposes microwave treatment of ores to facilitate subsequent processing of the ores based on differences in thermal expansion of minerals within ore particles when heated by pulsed microwave irradiation, leading to micro-cracking. However the only method suggested for applying microwave energy to ore is to allow the ore to free-fall down a transfer chute past a microwave energy generator, which is preferred to a forced feed arrangement because of unspecified materials handling issues often associated with the mining industry. The untreated ore may be transported to the chute by conveyor and the treated ore transported from the chute by conveyor.

US 2005/0236403 discloses a method of heating multiphase material, such as ore, with microwave radiation in which the material moves through a microwave treatment area, or more specifically passing the material through a microwave resonant cavity in a continuous stream. A single mode resonant cavity with the material passing through a maxima of a standing wave is preferred, in the acknowledged absence of a sufficiently powerful multi-mode resonant cavity machine at a reasonable cost. Moreover, a single mode resonant cavity is required for the perceived requirement for a large temperature gradient which is created quickly. Moreover, a single mode resonant cavity allows the material to be located in a position of maximum electromagnetic field strength. However, multimode type cavities are regarded as being preferred if a power density created thereby were sufficiently large. The resonant cavity is arranged so that the ore flows vertically, or inclined to the vertical, in free-fall through the resonant cavity. A suggestion is that the arrangement can be horizontal, for example minerals are moved on a conveyor belt underneath a horn through a zone irradiated by microwaves. In another embodiment the minerals are transported through an irradiation zone by a pneumatic pump. In another embodiment coal is transported through an irradiation zone on an inclined slide under gravity to dehydrate the coal. Pressure fed, conveyor fed, fluidised particle fed, centrifugal fed or hopper fed arrangements are all contemplated. A control processor may control tuning of the microwave resonant cavity. Flow-rate control means may vary a volume flow rate through the microwave resonant cavity. A particle size sensor may provide information to the control processor relating to a size of the materials being irradiated.

It is probable that ore to be treated will vary in composition, size and volume fraction—a measure of an amount of air around the untreated ore. This variability results in a varying and unpredictable load, to which multimode resonant cavity applicators are very susceptible—affecting modes supported and hence an electric field pattern generated in a resonant cavity. This could result in large variations in energy absorption in material to be processed, reducing process efficiency.

According to the invention there is provided an apparatus for comminution of ore material comprising: radio frequency processing resonant cavity means arranged for radio frequency electromagnetic irradiation of a stream of ore material passing therethrough; generating means for generating an electromagnetic field in the processing resonant cavity means; measurement means, arranged to determine an impedance of ore material to be irradiated in the processing resonant cavity and matching means arranged to match a radio frequency field generated in the processing resonant cavity means by the generating means to the determined impedance.

Conveniently, the measurement means comprises resonant cavity means, located upstream of the processing resonant cavity means.

Conveniently at least one of the processing resonant cavity means and the measurement resonant cavity means is a multi-input resonant cavity means.

Conveniently at least one of the processing resonant cavity means and the measurement resonant cavity means is a multimode resonant cavity means.

Advantageously, the processing resonant cavity means comprises an entry aperture and an exit aperture for passing the stream of ore material therethrough, the entry aperture and exit aperture further comprising shielding means for substantially limiting leakage of radio frequency electromagnetic radiation from the resonant cavity.

Conveniently, the generating means comprises a microwave generator for generating microwave radiation to irradiate the processing resonant cavity and a microwave circulator located between the microwave generator and processing resonant cavity means.

Conveniently, the matching means comprises a matching unit located between the microwave generator means and the processing resonant cavity means Conveniently, the apparatus is arranged for the ore material to pass substantially horizontally through the apparatus, comprising conveyor means with electrically conductive belt means for transporting the ore material through the apparatus wherein the belt means comprises a floor of the processing resonant cavity means.

Alternatively, the apparatus is arranged for the ore material to pass substantially vertically through the apparatus, comprising dielectric hollow cylinder means passing through the processing resonant cavity arranged such that the ore material passes vertically through the dielectric hollow cylinder means through the processing resonant cavity.

Conveniently, the apparatus comprises feed means arranged to keep the dielectric hollow cylinder means substantially fully charged with flowing ore material.

Advantageously, the feed means comprises hopper means for regulating a flow of ore material into the dielectric hollow cylinder means.

Advantageously, the feed means comprises throttle means for controlling a flow of ore material from the dielectric hollow cylinder means.

Conveniently, the apparatus is arranged for irradiating ore material with microwave radiation.

According to a second aspect of the invention, there is provided a method for comminution of ore material comprising: radio frequency electromagnetic irradiation of a stream of ore material passing through a radio frequency processing resonant cavity means; determining an impedance of ore material to be irradiated in the processing resonant cavity by measurement means; and matching a radio frequency electrical field generated in the processing resonant cavity means to the determined impedance.

Conveniently, determining an impedance of ore material comprises is by measurement resonant cavity means located upstream of the processing resonant cavity means.

Conveniently at least one of the processing resonant cavity means and the measurement resonant cavity means is a multi-input resonant cavity means.

Conveniently at least one of the processing resonant cavity means and the measurement resonant cavity means is a multimode resonant cavity means.

Conveniently, the method comprises passing the stream of ore material through an entry aperture and an exit aperture of the processing resonant cavity means; and shielding the radio frequency electromagnetic radiation from leaking from the resonant cavity.

Advantageously, the method further comprises measuring impedance of the ore material to be irradiated for matching irradiation produced by the processing resonant cavity means to the impedance of the load.

Conveniently the method comprises measuring power reflected from the load in the measurement resonant cavity means.

Conveniently, the method comprises generating microwave radiation and applying the microwave radiation to the processing resonant cavity means via microwave circulator means located between microwave generator means and the processing resonant cavity means.

Conveniently the method comprises passing ore material substantially horizontally through the apparatus, using conveyor means with electrically conductive belt means to transport the ore material through the apparatus wherein the belt means comprises a floor of the processing resonant cavity means.

Alternatively, the method comprises passing the ore material substantially vertically through dielectric hollow cylinder means passing through the processing resonant cavity means.

Conveniently, the method comprises using feed means to keep the dielectric hollow cylinder means substantially fully charged with flowing ore material.

Conveniently, the method comprises regulating a flow of ore material into the dielectric hollow cylinder means using hopper means.

Conveniently, the method comprises controlling a flow of ore material from the dielectric hollow cylinder means with throttle means.

Advantageously, the method comprises irradiating ore material with microwave radiation.

The invention will now be described, by way of example, with reference to the accompanying drawings in which.

In the Figures, like reference numbers denote like parts.

Figure 1:
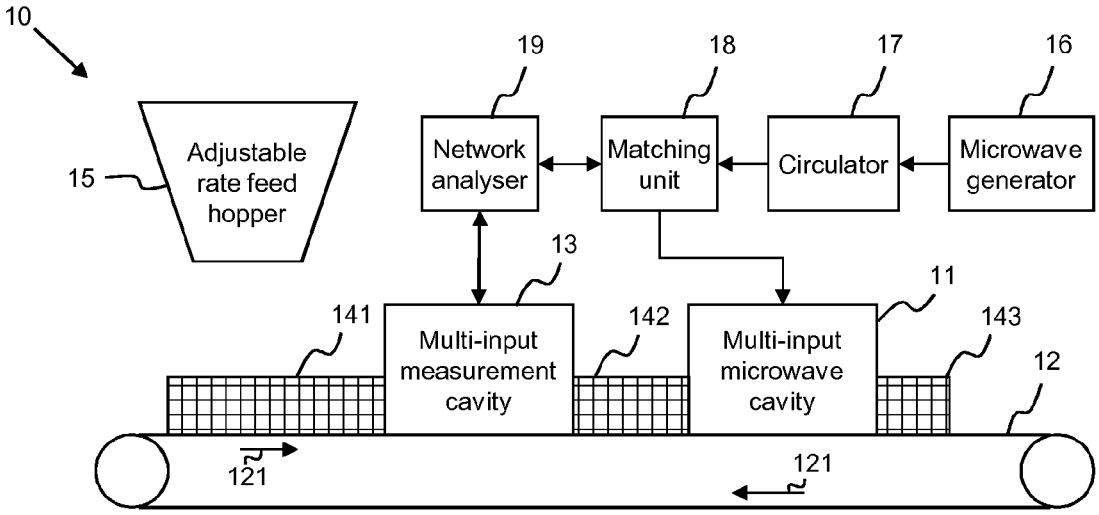
FIG. 1 is a schematic drawing of a side view of a first embodiment of an apparatus according to the invention.
Figure 2:
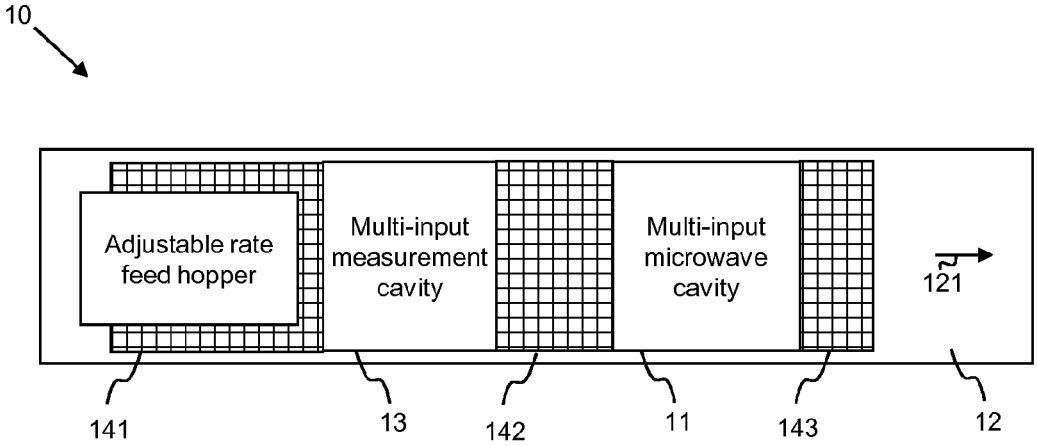
FIG. 2 is a schematic plan view of the first embodiment of FIG. 1.
Figure 3:
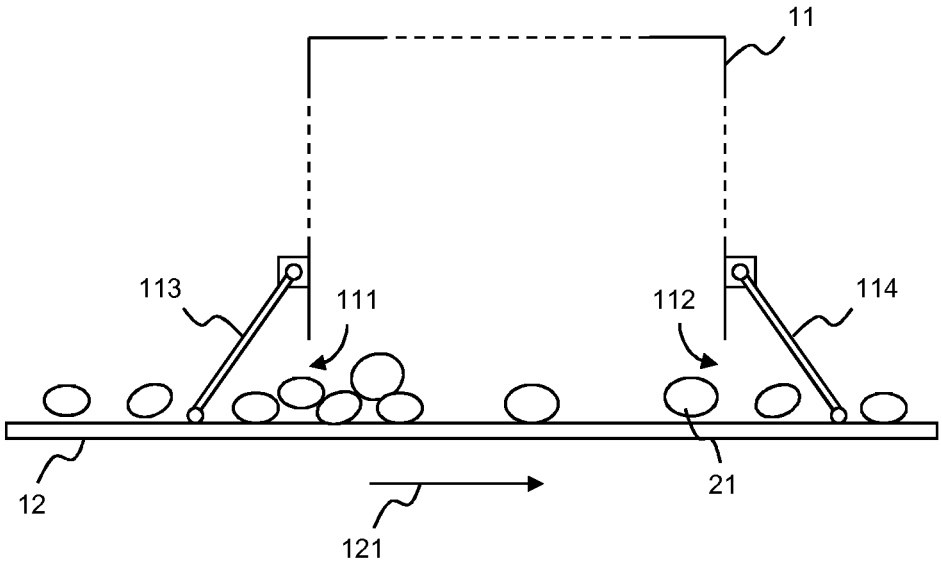
FIG. 3 is a detailed schematic side view of a radiation screening device for use with the embodiment of FIG. 1.
Figure 4:
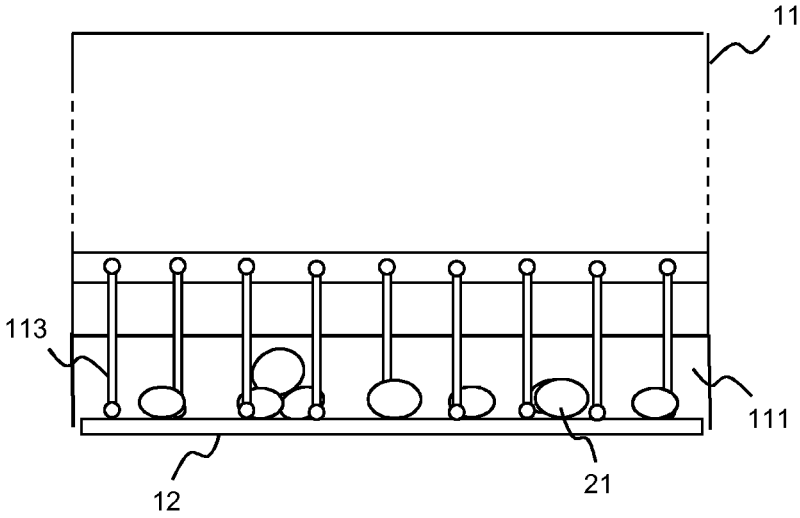
FIG. 4 is a front view of the radiation screening device of FIG. 3.

Referring to a side view in FIG. 1 and a plan view in FIG. 2, in an apparatus 10 according to the invention, a multi-input, multimode microwave resonant cavity 11 has a floor formed from a conveyor belt 12 of metal or other at least partially electrically conducting material which circulates in the direction of arrows 121. The resonant cavity may have, for example, three waveguide input ports, not shown, optimally positioned for generation of an efficient electromagnetic field within the resonant cavity, for example with uniform power density. Where there is an unknown variability of the nature of the ore or other material to be processed, minimum and maximum power density levels may be set which result in an acceptable level of improved comminution of the ore material. As best seen in FIGS. 3 and 4, the microwave resonant cavity is provided on an upstream side thereof with an entry aperture 111 and on an opposed downstream side with an exit aperture 112, such that the conveyor belt 12 passes into the resonant cavity through the entry aperture and passes out of the resonant cavity through the exit aperture 112 in the direction of arrow 121.

Upstream of the microwave resonant cavity located over the conveyor belt there is provided a multi-input measurement resonant cavity 13, preferably identical to the processing resonant cavity 11, arranged to measure the impedance of a load on the conveyor belt 12. The multi-input measurement resonant cavity 13 is provided with entry and exit apertures in the same manner as the microwave resonant cavity.

One or more of the ports of the cavity 13 is used to measure the complex impedance of the load using a vector network analyser 19 (or similar instrument), for example, by measuring the amplitude and phase of microwave energy reflected at the port or ports. The measured value(s) of complex impedance are used to compute the optimum settings for the external matching unit 18, which may be an E-H waveguide tuner, a three plunger (or screw) waveguide tuner or similar tuning device.

It is not essential for the separate measurement cavity 13 to be provided. The network analyser could be arranged to measure the amplitude and phase of microwave energy reflected from the processing cavity 11, for example, at the port or ports at which microwave energy is injected, and to control the matching unit accordingly. Indeed, a separate matching unit 18 itself is not essential, since it could be incorporated into the processing cavity 11.

Although the microwave cavities are schematically shown as cuboid, it will be understood that any suitably-shaped resonant cavity may be used, through which a conveyor belt may pass.

Protruding from and surrounding each of the entry and exit apertures on at least three sides are shielding grids 141, 142, 143 respectively. The shielding grid 142 between the measurement resonant cavity and the microwave resonant cavity extends from the exit resonant cavity of the measurement resonant cavity to the entry resonant cavity of the microwave resonant cavity. The shielding grid 141 at the entry aperture of the measurement resonant cavity extends beneath an output of an adjustable rate feed hopper 15. It will be understood that if alternatively the measurement resonant cavity 13 is at a sufficient distance from the processing resonant cavity 11 it may be more cost effective to provide separate screening shields for the measurement resonant cavity exit aperture and the processing resonant cavity 11 entry aperture. It will be understood that in any case the processing resonant cavity and the measurement resonant cavity should be sufficiently spaced apart to prevent cross-coupling between them.

The grid spacing and thickness of the shielding grills are chosen so that the grill apertures are much smaller than the RF wavelength used in the cavities to limit RF emissions from the apertures but are preferably four times larger than a maximum rock size to be irradiated to allow the ore material to pass through the grids. An RF wavelength of 833 MHz results in grid apertures suitable for use with expected rock sizes. Frequencies allocated for industrial, scientific and medical use are 896 MHz in the UK and 915 MHz elsewhere.

An alternative or additional form of shielding is illustrated in FIGS. 3 and 4 in which a series of parallel electrically conducting arms 113, 114 are pivoted at their upper ends above the entry and exit apertures respectively, each to move pivotally in a respective vertical plane substantially parallel to a major longitudinal axis of the conveyor belt 12. A free end of each arm rests on, and preferably makes electrical contact with, the conveyor belt 12. The parallel arms are spaced apart by a distance significantly smaller than a wavelength of radiation used in the cavities, to prevent RF leakage through the grid, but sufficiently large to allow particles of ore to pass between the arms. The advantage of the arms being pivoted such that free ends of the arms rest of the conveyor belt is that the arm remains in electrical contact with the conveyor belt during vertical perturbations of the belt. However, it will be understood that other means of achieving this contact could be employed which biased grid members towards the conveyor belt, for example by a spring or using a hydrostatic or pneumatic damper.

An advantage of use of a conveyor belt at least partially of metal for handling ore materials is a requirement for an abrasion-resistant and wear-resistant belt in a rock handling environment.

Referring again to FIG. 1, the apparatus is provided with a microwave generator 16 which feeds a matching unit 18 through a microwave circulator 17 which protects the microwave generator in the event of arcing in the microwave resonant cavity. The matching unit 18 is arranged to receive an input from the multi-input measurement resonant cavity which is fed via a vector network analyser 19 to the matching unit 18 in order to match the microwave radiation to the load to be irradiated.

In use, a stream of mineral ore flows from the variable rate hopper 15 through a mesh of an upper wall of the shielding grid 141 located at the entry aperture of the multi-input measurement resonant cavity 13. The mineral ore 21 passing through the mesh is carried by the conveyor belt 12 through the entry aperture of the measurement resonant cavity 13, and around pivoted arms of a secondary shield 113 if such a secondary shield is used. Reflected power is measured at each input port of the measurement resonant cavity to measure the system impedance of the conveyor belt and ore prior to entry to the main processing resonant cavity 11. A signal is input from the measurement resonant cavity to the matching unit 18 in order to match microwave power passed from the microwave generator to the microwave processing resonant cavity 11 to the measured system impedance, allowing tuning of the processing resonant cavity dynamically to be preset to the load to be processed. Alternatively, or in addition, at least one of a mineral feed rate from the variable rate hopper and a speed of the conveyor belt is adjusted in response to measurements of the reflected power at at least one of the measurement resonant cavity 13 and the processing resonant cavity 11.

Figure 5:
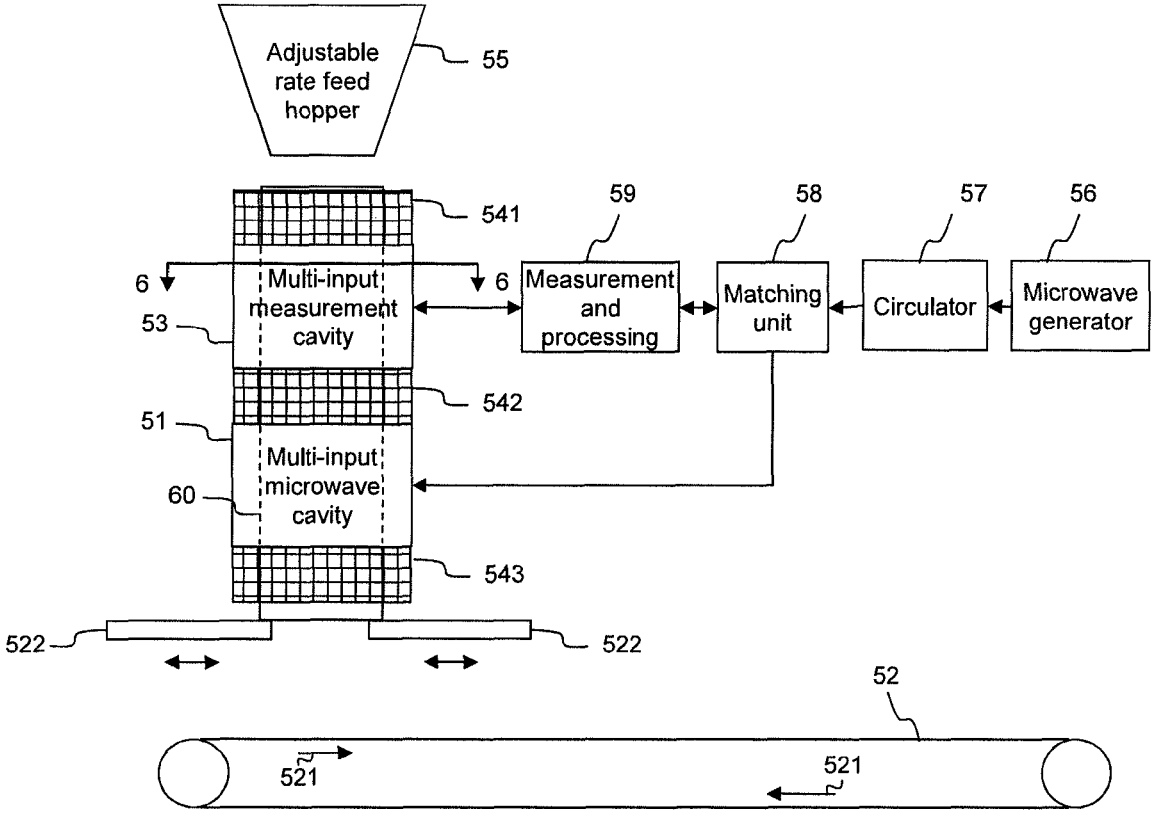
FIG. 5 is a schematic drawing of a side view of a second embodiment of an apparatus according to the invention.
Figure 6:
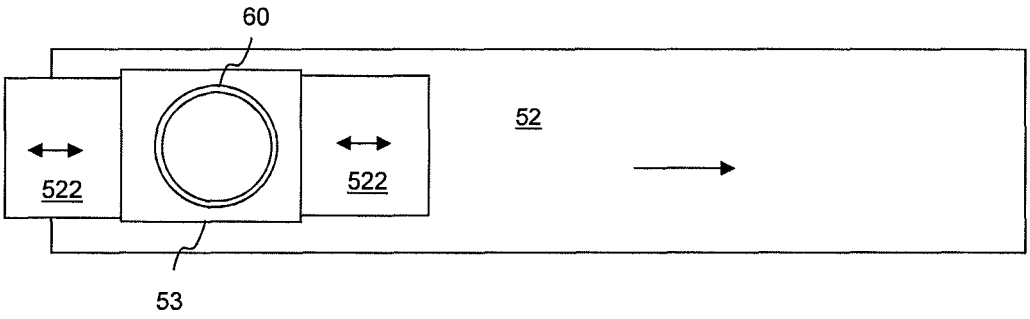
FIG. 6 is a schematic plan view of the second embodiment, but without the hopper, of FIG. 5.

Referring to FIGS. 5 and 6, in a second embodiment of the invention, material to be irradiated is fed vertically under gravity through a multi-input, multimode resonant cavity 51 similar to that of the first embodiment except that the resonant cavity has an upper entry aperture and a lower exit aperture. As with the first embodiment upstream of the microwave resonant cavity there is provided a multi-input measurement resonant cavity 53 arranged to measure the impedance of a load passing through the measurement resonant cavity. The multi-input measurement resonant cavity 53 is provided with upper entry and lower exit apertures in the same manner as the microwave resonant cavity 51.

Protruding from and surrounding each of the entry and exit apertures are shielding grids 541, 542, 543. The shielding grid 542 between the measurement resonant cavity 53 and the microwave resonant cavity 51 extends from the exit resonant cavity of the measurement resonant cavity to the entry resonant cavity of the microwave resonant cavity. It will be understood that the processing resonant cavity and the measurement resonant cavity should be sufficiently spaced apart to prevent cross-coupling between them. An adjustable rate feed hopper 55 is located above the shielding grid 541 at the entry aperture of the measurement resonant cavity 53.

A dielectric hollow cylinder 59 extends through the measurement resonant cavity and microwave resonant cavity through which material to be irradiated passes from the hopper 55 to prevent arcing from the material to the walls of the cavities.

A variable throttle 522 is provided at a lower end of the dielectric cylinder to enable the cavities to be maintained full of material being irradiated to maintain a more constant load in the resonant cavity.

A conveyor belt 52 rotating in the direction of arrows 521 may be provided below the variable throttle to transport irradiated material away from the apparatus.

Referring again to FIG. 5, the apparatus is provided with a microwave generator 56 which feeds a matching unit 58 through a microwave circulator 57 which protects the microwave generator in the event of arcing in the microwave resonant cavity. The matching unit 58 is arranged to receive an input from a measurement and processing module 59 which receives an input from the multi-input measurement resonant cavity 53 in order to match the microwave radiation to the load to be irradiated.

Operation of the second embodiment is similar to that of the first embodiment except that additional control may be provided by the throttle aperture 522 to ensure that the resonant cavity is maintained substantially fully loaded during irradiation. This maintains more consistent system impedance from the load in the processing resonant cavity 51 and is expected to reduce abrasion in the resonant cavity compared with free-fall operation.

Irradiation of the cavities in either of the described embodiments may be by slotted waveguide antennas providing substantially uniform power radiation from each slot. If the resonant cavity is relatively large, the slotted waveguide antennas can be arranged to focus a high-intensity uniform electric field to ensure repeatable power loss densities are achieved with varying materials.

Although reference has been made herein to the use of electromagnetic radiation at microwave frequencies, it will be understood that lower radio frequencies may be used, particularly for materials in which the real and imaginary dielectric constants increase with decreasing frequency.

In addition to the electromagnetic radiation shields described, the whole apparatus or parts thereof may be located within one or more Faraday cages for additional electromagnetic radiation containment if required.

The invention claimed is:

1. An apparatus for comminution of ore material comprising:

a radio frequency processing resonant cavity arranged for radio frequency electromagnetic irradiation of a stream of ore material passing therethrough;

a generator device to generate an electromagnetic field in the processing resonant cavity;

a measurement device arranged to determine an impedance of ore material to be irradiated in the processing resonant cavity; and a matching unit arranged to match the electromagnetic field generated in the processing resonant cavity by the generator device to the determined impedance.

2. The apparatus of claim 1, wherein the measurement device comprises a resonant cavity, located upstream of the processing resonant cavity.

3. The apparatus of claim 1, wherein at least one of the processing resonant cavity and the measurement resonant cavity comprises a multi-input resonant cavity.

4. The apparatus of claim 1, wherein at least one of the processing resonant cavity and the measurement resonant cavity comprises a multimode resonant cavity.

5. The apparatus of claim 1, wherein the processing resonant cavity comprises an entry aperture and an exit aperture to pass the stream of ore material therethrough, and further comprising a radio frequency emission shield to substantially limit leakage of radio frequency electromagnetic radiation from the processing resonant cavity.

6. The apparatus of claim 1, wherein the generator device comprises a microwave generator to generate microwave radiation to irradiate the processing resonant cavity, and further comprising:

a microwave circulator located between the microwave generator and the processing resonant cavity.

7. The apparatus of claim 6, wherein the matching unit is located between the microwave generator and the processing resonant cavity.

8. The apparatus of claim 1, wherein at least the processing resonant cavity is arranged for the ore material to pass substantially horizontally therethrough, and further comprising:

a conveyor with an electrically conductive belt to transport the ore material through the processing resonant cavity, wherein the belt defines a floor of the processing resonant cavity.

9. The apparatus of claim 1, wherein at least the processing resonant cavity is arranged for the ore material to pass substantially vertically therethrough, and further comprising:

a dielectric hollow cylinder passing through the processing resonant cavity and arranged such that the ore material passes though the dielectric hollow cylinder through the processing resonant cavity.

10. The apparatus of claim 9, further comprising an adjustable feeder arranged to keep the dielectric hollow cylinder substantially fully charged with flowing ore material.

11. The apparatus of claim 10, wherein the feeder comprises an adjustable hopper to regulate a flow of ore material into the dielectric hollow cylinder.

12. The apparatus of claim 10, wherein the feeder comprises a throttle to control a flow of ore material from the dielectric hollow cylinder.

13. The apparatus of claim 1, wherein the generator device is arranged to irradiate the passing stream of ore material with microwave radiation.

14. A method for comminution of ore material comprising:

determining an impedance of a passing stream of ore material to be irradiated in a radio frequency processing resonant cavity;

matching a radio frequency electromagnetic field generated in the processing resonant cavity to the determined impedance; and irradiating the stream of ore material passing through the processing resonant cavity with the generated radio frequency electromagnetic field.

15. The method of claim 14, wherein the impedance of the ore material is determined by a measurement resonant cavity located upstream of the processing resonant cavity.

16. The method of claim 15, wherein at least one of the processing resonant cavity and the measurement resonant cavity comprises is a multi-input resonant cavity.

17. The method of claim 15, wherein at least one of the processing resonant cavity and the measurement resonant cavity comprises a multimode resonant cavity.

18. The method of claim 14, further comprising passing the stream of ore material through an entry aperture and an exit aperture of the processing resonant cavity; and substantially limiting radio frequency electromagnetic radiation leakage through the entry aperture and the exit aperture from the processing resonant cavity.

19. The method of claim 14, wherein the determining comprises measuring an impedance of the ore material to be irradiated.

20. The method of claim 19, wherein the measuring comprises measuring power reflected from the passing ore material in a measurement resonant cavity.

21. The method of claim 14, wherein the generating comprises generating microwave radiation and applying the microwave radiation to the processing resonant cavity via a microwave circulator located between the microwave generator and the processing resonant cavity.

22. The method of claim 14, wherein the passing comprises transporting the stream of ore material substantially horizontally through the processing resonant cavity using a conveyor with an electrically conductive belt, wherein the belt defines a floor of the processing resonant cavity.

23. The method of claim 14, wherein the passing comprises passing the stream of ore material substantially vertically through a dielectric hollow cylinder means located within the processing resonant cavity.

24. The method of claim 14, further comprising using a feeder to maintain the dielectric hollow cylinder substantially fully charged with flowing ore material.

25. The method of claim 24, further comprising regulating a flow of the ore material into the dielectric hollow cylinder using an adjustable hopper.

26. The method of claim 24, further comprising controlling a flow of the ore material from the dielectric hollow cylinder with a throttle.

27. The method of claim 14, wherein the generating comprises generating microwave radiation with a microwave generator, and further comprising irradiating the passing stream of the ore material with the microwave radiation.

* * * * *